US010280660B2

(12) United States Patent
Nozawa et al.

(10) Patent No.: US 10,280,660 B2
(45) Date of Patent: May 7, 2019

(54) VEHICLE DOOR LATCH DEVICE

(71) Applicant: MITSUI KINZOKU ACT CORPORATION, Kanagawa (JP)

(72) Inventors: Hideaki Nozawa, Kanagawa (JP); Tomoharu Nagaoka, Kanagawa (JP)

(73) Assignee: Mitsui Kinzoku Act Corporation, Kanagawa (JP)

( * ) Notice: Subject to any disclaimer, the term of this patent is extended or adjusted under 35 U.S.C. 154(b) by 492 days.

(21) Appl. No.: 14/911,854

(22) PCT Filed: Dec. 12, 2014

(86) PCT No.: PCT/JP2014/083010

§ 371 (c)(1),
(2) Date: Feb. 12, 2016

(87) PCT Pub. No.: WO2016/067479

PCT Pub. Date: May 6, 2016

(65) Prior Publication Data

US 2016/0290020 A1 Oct. 6, 2016

(30) Foreign Application Priority Data

Oct. 29, 2014 (JP) ..... 2014-220835

(51) Int. Cl.
*E05B 77/38* (2014.01)
*E05B 85/26* (2014.01)
(Continued)

(52) U.S. Cl.
CPC ..... *E05B 85/26* (2013.01); *E05B 77/38* (2013.01); *E05B 85/02* (2013.01); *E05C 3/004* (2013.01);
(Continued)

(58) Field of Classification Search
CPC ..... E05B 77/38
See application file for complete search history.

(56) References Cited

U.S. PATENT DOCUMENTS 3,876,238 A * 4/1975 Watermann ..... E05B 77/38 292/216
4,165,112 A * 8/1979 Kleefeldt ..... E05B 85/045 292/216
(Continued)

FOREIGN PATENT DOCUMENTS

CN 1603561 A 4/2005
CN 102275532 A 12/2011
(Continued)

OTHER PUBLICATIONS

Office Action issued in corresponding Chinese Patent Application No. 201480045489.2, dated Mar. 14, 2017.
(Continued)

*Primary Examiner* — Carlos Lugo
(74) *Attorney, Agent, or Firm* — McDermott Will & Emery LLP

(57) ABSTRACT

A vehicle door latch device includes: a body includes a striker advancing groove into which a striker advances along with closing movement of the door; a latch configured to interlock with the advanced striker so as to be rotatable from an open position to a latched position; a pawl configured to be biased to rotate, in a direction towards an engaged position where the pawl is engageable with the latch in the latched position from a released position where engagement with the latch is canceled, and restrain the door in a closed position by rotating from the engaged position to the released position in conjunction with rotation of the latch, rotating from the released position to the engaged position
(Continued)

by biasing force, and engaging with the latch; and a buffer that is made of an elastic member.

6 Claims, 12 Drawing Sheets

(51) Int. Cl.

| | |
|---|---|
| ***E05B 85/02*** | (2014.01) |
| ***E05C 3/00*** | (2006.01) |
| ***E05C 3/12*** | (2006.01) |
| ***E05C 19/12*** | (2006.01) |
| *E05B 85/24* | (2014.01) |
| *E05B 81/06* | (2014.01) |

(52) U.S. Cl.
CPC ..... *E05C 3/124* (2013.01); *E05C 19/12* (2013.01); *E05B 81/06* (2013.01); *E05B 85/24* (2013.01)

(56) References Cited

U.S. PATENT DOCUMENTS

| | | | | | |
|---|---|---|---|---|---|
| 4,869,536 | A * | 9/1989 | Kleefeldt | E05B 77/38 | 292/210 |
| 4,941,696 | A * | 7/1990 | Yamada | E05B 77/38 | 292/216 |
| 5,064,229 | A * | 11/1991 | Hamada | E05B 85/045 | 292/216 |
| 5,106,134 | A * | 4/1992 | Thau | E05B 85/045 | 292/216 |
| 5,727,825 | A * | 3/1998 | Spurr | E05B 85/26 | 292/341.12 |
| 7,306,269 | B2 * | 12/2007 | Cetnar | E05B 85/26 | 292/216 |
| 7,401,822 | B2 * | 7/2008 | Graute | E05B 77/38 | 292/216 |
| 7,845,692 | B2 * | 12/2010 | Inan | E05B 77/38 | 292/216 |
| 8,342,582 | B2 * | 1/2013 | Bendel | E05B 85/02 | 292/216 |
| 8,348,309 | B2 * | 1/2013 | Patel | E05B 77/38 | 292/195 |
| 8,662,545 | B2 | 3/2014 | Taga | | |
| 9,249,607 | B2 * | 2/2016 | Akizuki | E05B 85/26 | |
| 9,777,515 | B2 * | 10/2017 | Barmscheidt | E05B 81/06 | |
| 2005/0073156 | A1 | 4/2005 | Oh | | |
| 2009/0224559 | A1 | 9/2009 | Park | | |
| 2011/0304160 | A1 | 12/2011 | Kamata et al. | | |
| 2012/0096905 | A1 | 4/2012 | Yamagata et al. | | |
| 2012/0126550 | A1 | 5/2012 | Patel et al. | | |
| 2012/0193926 | A1 | 8/2012 | Watanabe et al. | | |
| 2014/0319852 | A1 | 10/2014 | Shimura et al. | | |
| 2015/0084352 | A1 * | 3/2015 | Barmscheidt | E05B 81/15 | 292/201 |
| 2015/0204114 | A1 * | 7/2015 | Nurmi | E05B 85/26 | 292/194 |

FOREIGN PATENT DOCUMENTS

| | | | |
|---|---|---|---|
| EP | 2472035 | A1 | 7/2012 |
| JP | 2003-301646 | A | 10/2003 |
| JP | 2010-031521 | A | 2/2010 |
| JP | 4765123 | B2 | 9/2011 |
| JP | 2012-158866 | A | 8/2012 |
| JP | 2012-233318 | A | 11/2012 |
| JP | 2013-011061 | A | 1/2013 |
| JP | 2013-139701 | A | 7/2013 |
| JP | 2014-185430 | A | 10/2014 |
| JP | 2014-214478 | A | 11/2014 |

OTHER PUBLICATIONS

Extended European Search Report issued in corresponding European Patent Application No. 14898360A, dated Jun. 28, 2017.

Japanese Office Action issued in corresponding Jaspanese Patent Application No. 2014-220835, dated Jun. 5, 2018, with English Translation.

Japanese Decision to Grant a Patent issued in corresponding Japanese Patent Application No. 2014-220835, dated Oct. 16, 2018, with English Translation.

* cited by examiner

VEHICLE DOOR LATCH DEVICE

CROSS-REFERENCE TO RELATED APPLICATIONS

This Application is the U.S. National Phase of PCT/JP2014/083010 filed Dec. 12, 2014, which claims priority to Japanese Patent Application No. 2014-220835 filed Oct. 29, 2014. The subject matter of each is incorporated herein by reference in entirety.

FIELD

The present invention relates to a vehicle door latch device.

BACKGROUND

Vehicle door latch devices include those, each having an interlocking unit assembly and an operating unit assembly integrated with each other, the interlocking unit assembly including: a body, which is fixed to a door and made of synthetic resin; and an interlocking mechanism, such as a latch and a pawl, the latch being accommodated in the body and engageable with a striker on a vehicle body side, and the pawl being engageable with the latch, and the operating unit assembly including: a casing fixed to a reverse side of the body; and an operating mechanism, which is assembled in the casing and is able to switch over the door between a locked state and an unlocked state by operations on the interlocking mechanism (see Patent Literatures 1 and 2).

CITATION LIST

Patent Literature

Patent Literature 1: Japanese Patent No. 4765123

Patent Literature 2: Japanese Laid-open Patent Publication No. 2012-233318

SUMMARY

Technical Problem

In recent years, automatic assembly is performed in order to improve assembly efficiency for door latch devices and there is a need for further improvement in the assembly efficiency. However, conventionally, when respective members of an interlocking unit assembly are assembled with a body of the interlocking unit assembly, the respective members are sometimes unable to be assembled from a single direction. As a result, there is a problem that a step of reversing the body is required and the assembly efficiency is reduced.

The present invention has been made in view of the above, and aims to provide a vehicle door latch device with improved assembly efficiency.

Solution to Problem

To solve the above-described problem and achieve the above-described object, a vehicle door latch device according to an embodiment of the present invention includes: a body that is provided in one of a door and a vehicle body, and includes, on one side thereof, a striker advancing groove into which a striker provided in the other one of the door and the vehicle body advances along with closing movement of the door; a latch configured to interlock with the advanced striker so as to be rotatable from an open position to a latched position; a pawl configured to be biased to rotate, in a direction towards an engaged position where the pawl is engageable with the latch in the latched position from a released position where engagement with the latch is canceled, and restrain the door in a closed position by rotating from the engaged position to the released position in conjunction with rotation of the latch, rotating from the released position to the engaged position by biasing force, and engaging with the latch; and a buffer that is made of an elastic member. The body includes an opening on an opposite side of the side where the striker advancing groove is formed and includes a buffer assembling hole that accommodates the buffer inserted from the opening. The buffer is arranged at an innermost portion of the striker advancing groove, and is configured to abut against the striker that has advanced and abut against the pawl that rotates from the released position to the engaged position.

In the vehicle door latch device according to the embodiment of the present invention, the body includes an opening on the opposite side of the side where the striker advancing groove is formed, and includes a pawl assembling hole that accommodates the pawl that has been inserted from the opening.

In the vehicle door latch device according to the embodiment of the present invention, the pawl includes a lever that cancels the engagement with the latch by causing, based on an opening operation on a handle provided in the door, the pawl to rotate from the engaged position to the released position.

Advantageous Effects of Invention

According to the present invention, a vehicle door latch device with improved assembly efficiency is able to be realized.

DESCRIPTION OF EMBODIMENTS

Hereinafter, with reference to the drawings, an embodiment of a vehicle door latch device according to the present invention will be described. The present invention is not limited by this embodiment. Further, in describing the drawings, the same signs will be appended to the same or corresponding elements, as appropriate.

Embodiment

Figure 1:
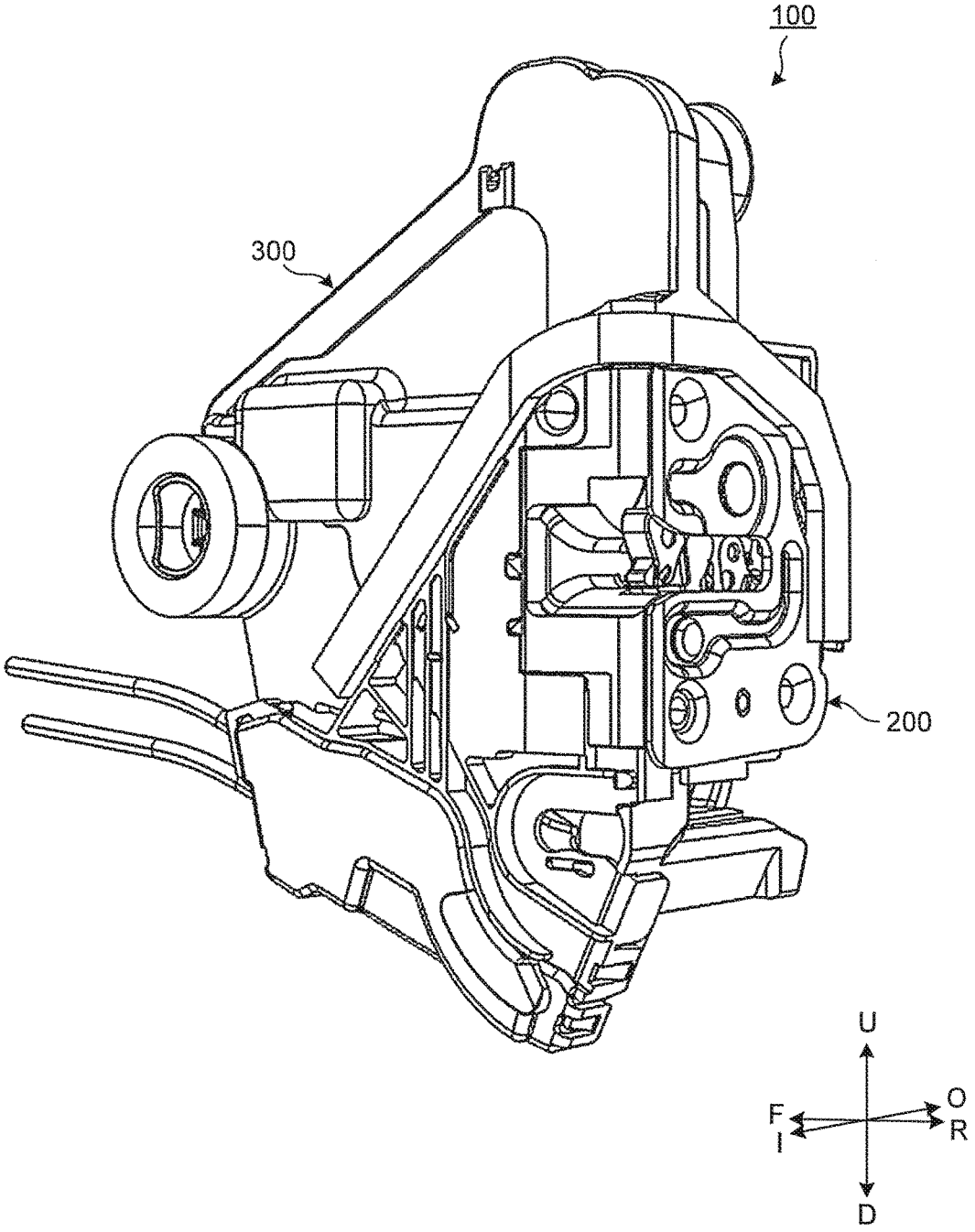
FIG. 1 is a perspective view of a vehicle door latch device according to an embodiment of the present invention.

Hereinafter, a door latch device according to an embodiment will be described based on FIG. 1 to FIG. 12. FIG. 1 is a perspective view of a vehicle door latch device according to an embodiment of the present invention. In the following description, in a state where a door latch device 100 has been installed in an automobile, the left in FIG. 1 will be referred to as "indoor side (I)", the right as "outdoor side (O)", the upside as "upside (U)", the downside as "downside (D)", the deeper side in the figure as "front (F)", and the shallower side in the figure as "rear (R)". These directions are defined for convenience of explanation, and of course, orientation of the door latch device 100 is modified depending on a type of an automobile to be installed, a position to be installed, and the like.

The door latch device 100 according to this embodiment is to be attached to a rear end portion in a front side door (hereinafter, abbreviated as "door") on a right side of an automobile, and is configured by assembling an interlocking unit assembly 200, which is for holding a door in a closed state by engaging with a striker on a vehicle body side, with an operating unit assembly 300, which is for operating the interlocking unit assembly 200, to integrate the interlocking unit assembly 200 with the operating unit assembly 300.

Figure 2:
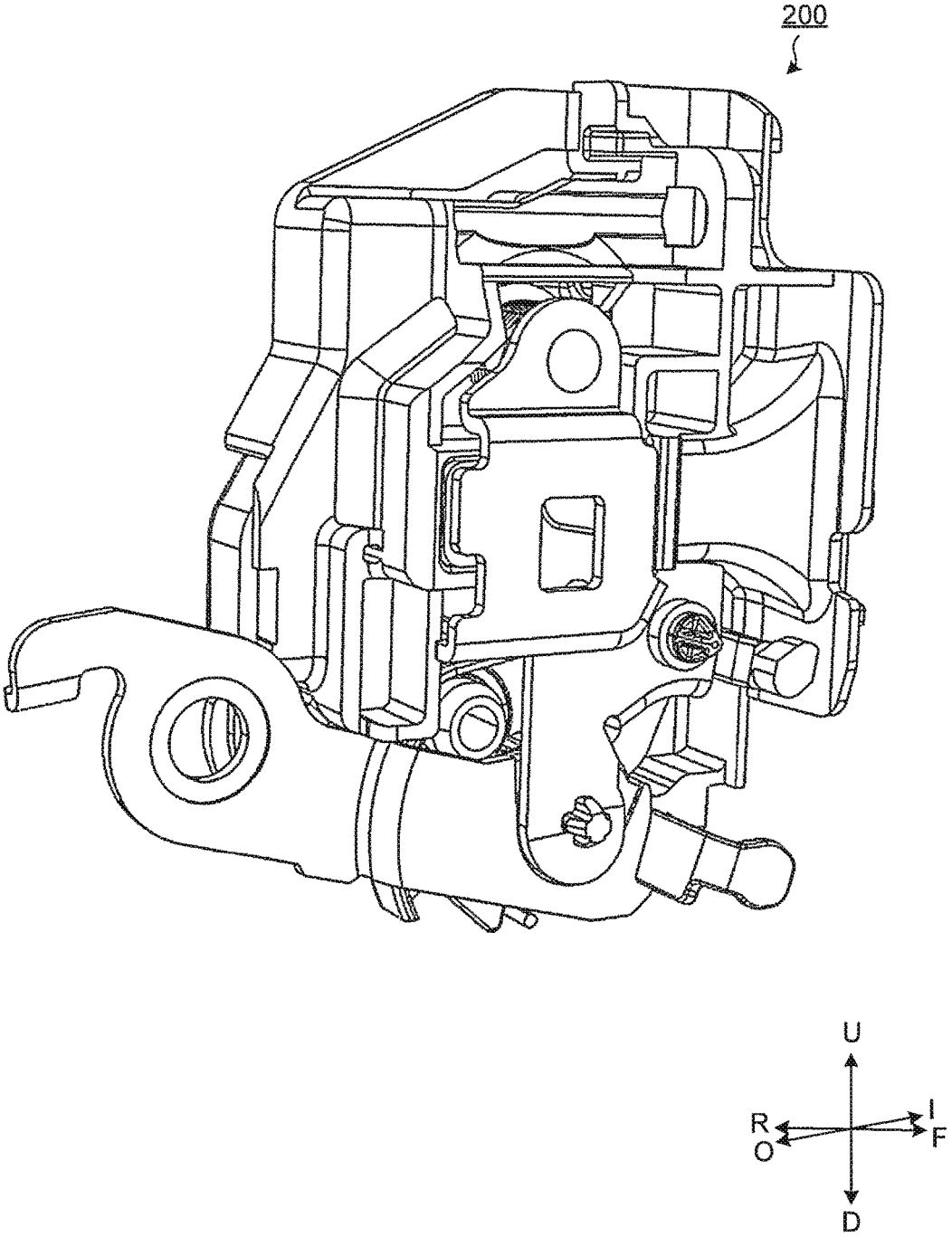
FIG. 2 is a perspective view of an interlocking unit assembly of the vehicle door latch device illustrated in FIG. 1.
Figure 3:
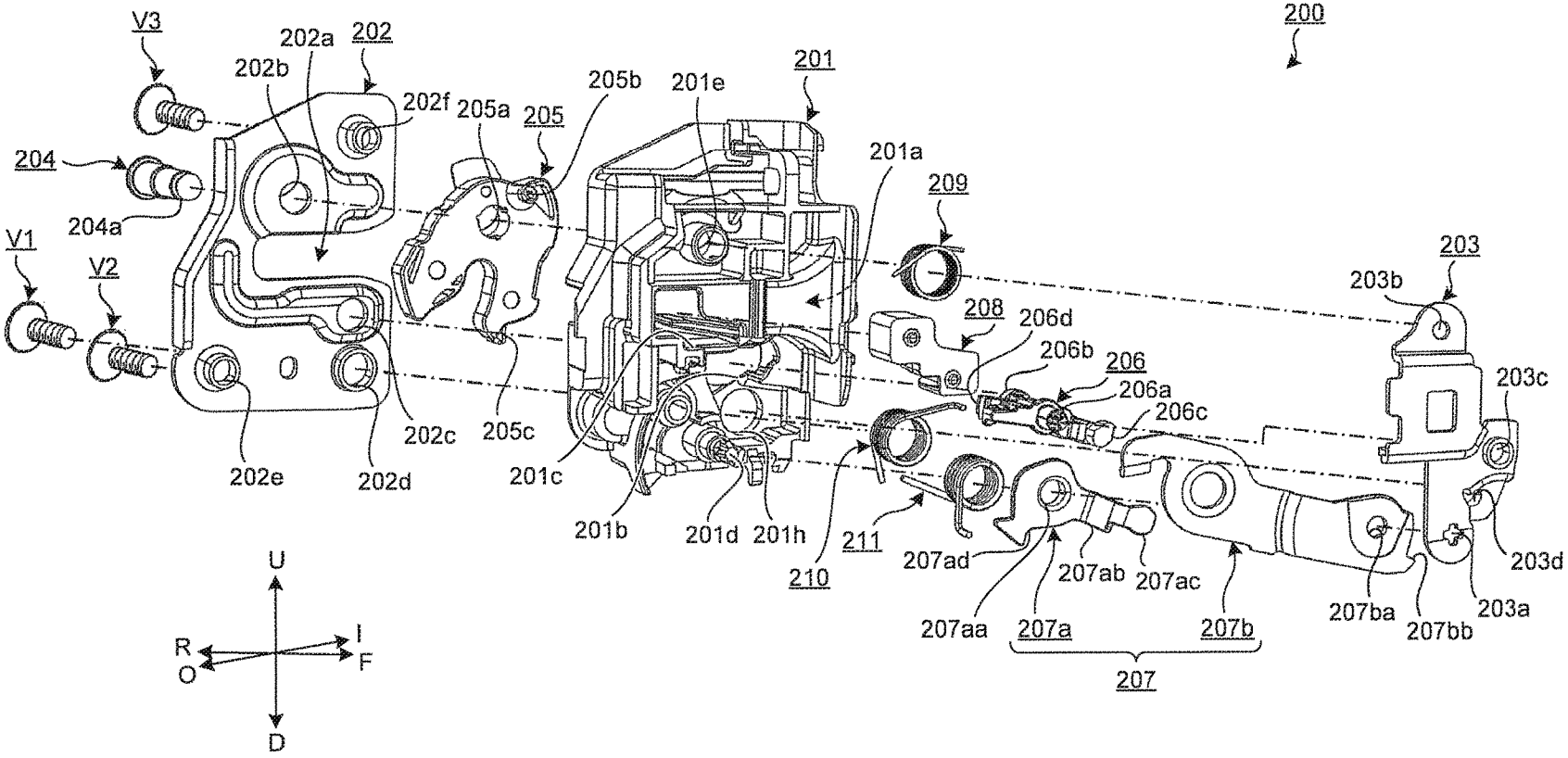
FIG. 3 is an exploded perspective view illustrating a configuration of the interlocking unit assembly illustrated in FIG. 2.

First, a configuration of the interlocking unit assembly 200 will be described. FIG. 2 is a perspective view of the interlocking unit assembly of the vehicle door latch device illustrated in FIG. 1. FIG. 3 is an exploded perspective view illustrating the configuration of the interlocking unit assembly illustrated in FIG. 2.

As illustrated in FIG. 3, the interlocking unit assembly 200 includes: a body 201; a cover plate 202 fixed on a rear side of the body 201; a back plate 203 fixed on a front side of the body 201; a latch shaft 204 inserted from a rear side; a latch 205 rotatably supported by the latch shaft 204; a pawl 206 that restrains the door in a closed position by engaging with the latch 205; an outside lever 207 that cancels the engagement between the latch 205 and the pawl 206; and a bumper rubber 208, which abuts against the striker that has advanced thereto and the pawl 206, and serves as a buffer.

Next, each member of the interlocking unit assembly 200 will be described in detail.

Figure 4:
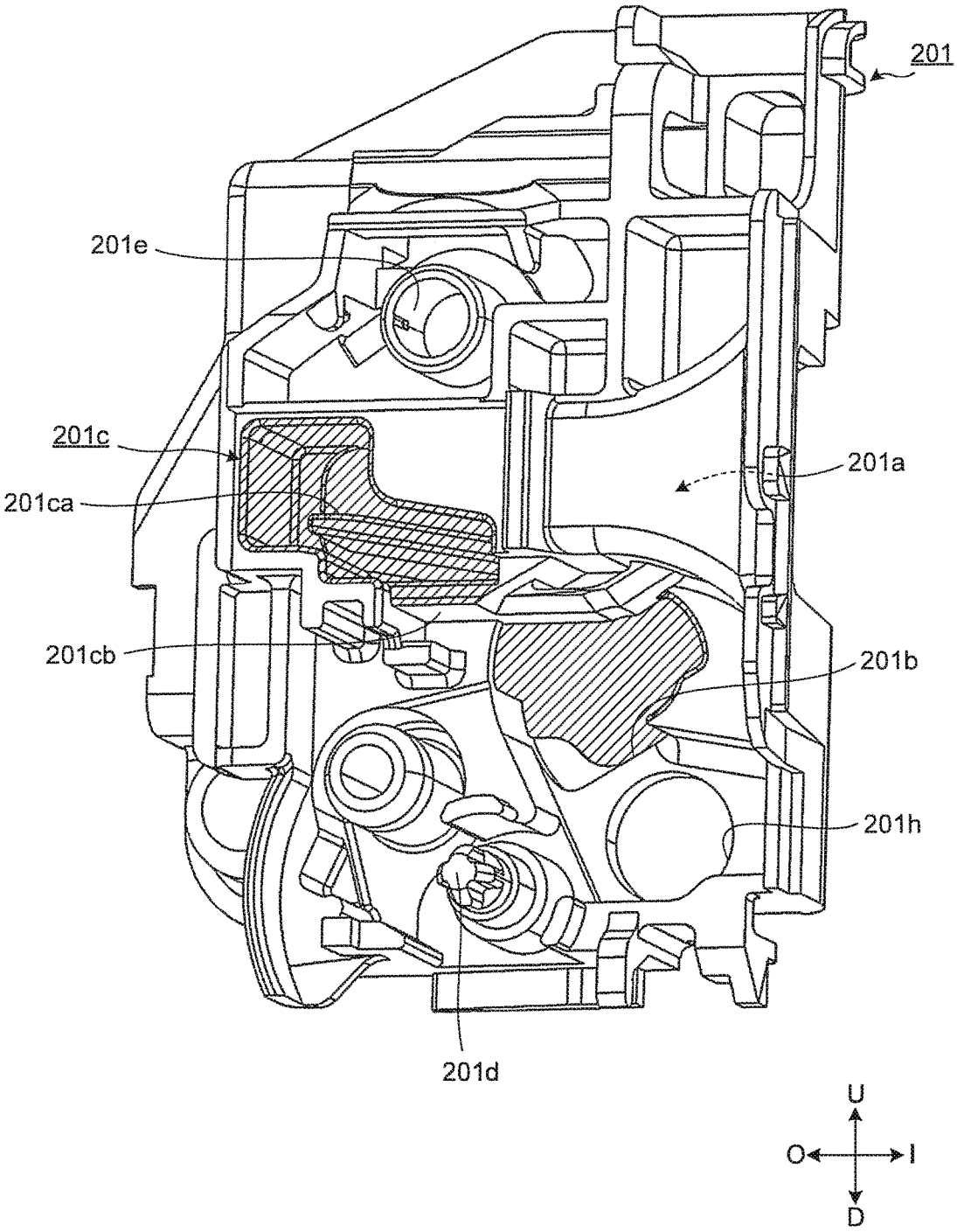
FIG. 4 is a perspective view of a front face side of the interlocking unit assembly illustrated in FIG. 2.

The body 201 is made of, for example, synthetic resin, and formed with, on one side (rear side) thereof, a striker advancing groove 201*a* through which the striker provided in the vehicle body advances along with closure movement of the door. FIG. 4 is a perspective view of a front face side of the body of the interlocking unit assembly illustrated in FIG. 2. As illustrated with hatching in FIG. 4, the body 201 has an opening on an opposite side (front side, which is a shallower side of the plane of the paper) of the side where the striker advancing groove 201*a* is formed, and has a pawl assembling hole 201*b* that accommodates the pawl 206 inserted from the opening. As illustrated similarly with hatching in FIG. 4, the body 201 has an opening on the opposite side (front side, which is the shallower side of the plane of the paper) of the side where the striker advancing groove 201*a* is formed, and has a bumper rubber assembling hole 201*c* serving as a buffer assembling hole that accommodates the bumper rubber 208 inserted from this opening. The bumper rubber assembling hole 201*c* has: a tongue portion 201*ca*, which is formed to extend in a front-rear direction at a rear side of the body 201; and a lower end portion 201*cb*, which protrudes to a front side of the body 201.

The cover plate 202 is made of, for example, various metals, has a notched portion 202*a* into which the striker is able to advance, and is assembled to a surface of the body 201 on the rear side where the striker advancing groove 201*a* is formed.

The back plate 203 is made of, for example, various metals, and fixed by the latch shaft 204 and a bolt V1, with the cover plate 202 and the body 201 interposed therebetween. As a result, the interlocking unit assembly 200 is integrated. Further, the back plate 203 has a cross shaped hole 203*a* into which a cross shaped projection formed at a distal end of a pivot 201*d* of the body 201 is inserted.

The latch shaft 204 penetrates, from a rear side, through a shaft hole 202*b* of the cover plate 202, a shaft hole 205*a* of the latch 205, and a shaft hole 201*e* of the body 201 in this order, and a small diameter shaft portion 204*a* at a distal end portion thereof is press fitted to be substantially unrotatable into a shaft hole 203*b* of the back plate 203.

The latch 205 is pivotally supported by the latch shaft 204, accommodated in the rear side interior of the body 201, interlocks with the striker that has advanced thereto, and rotates about an axis of the latch shaft 204 from an open position via a half closed door position to a latched position. Furthermore, the latch 205 has an engagement portion 205*b* protruding to a front side.

Figure 5:
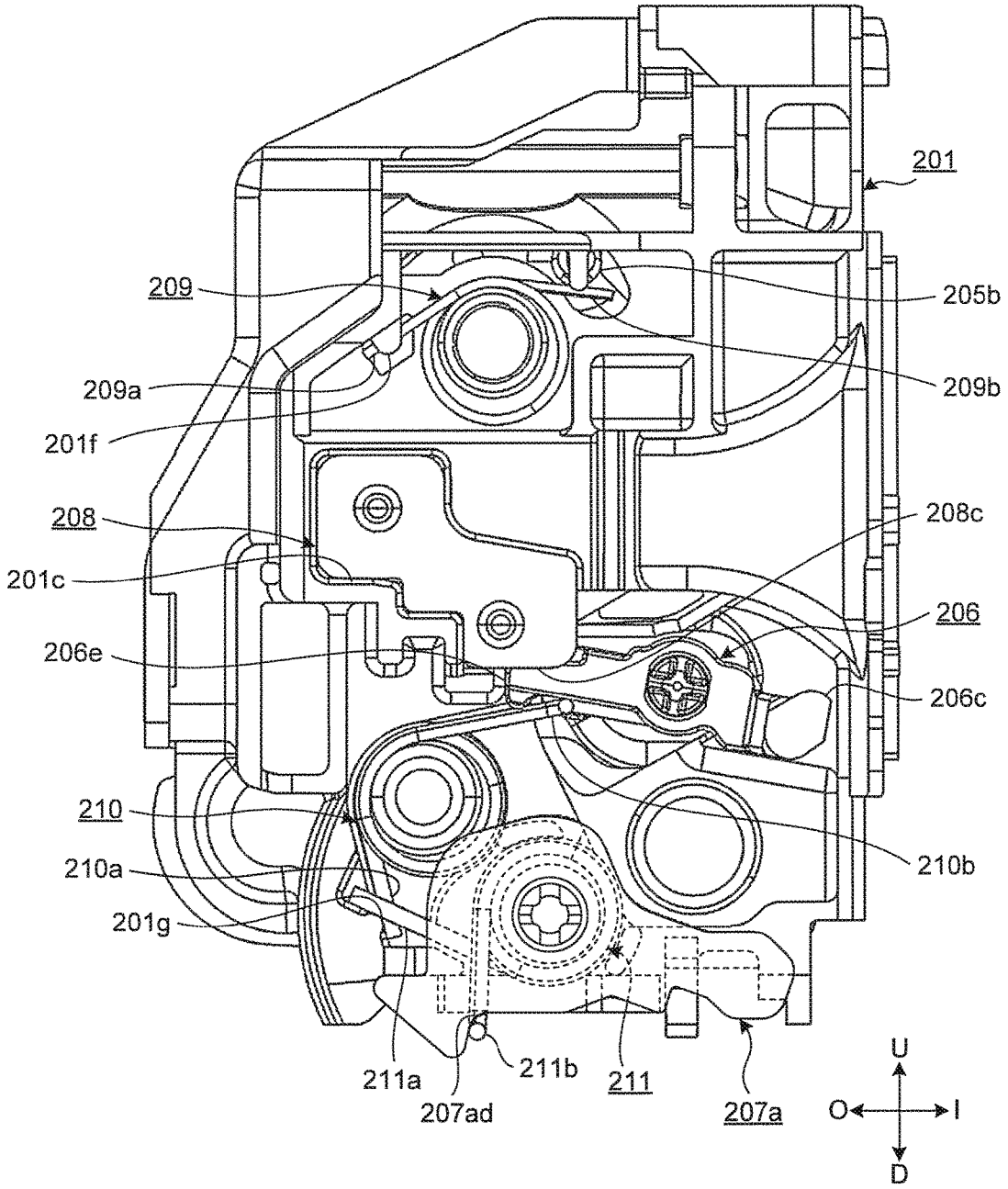
FIG. 5 is a front view illustrating an internal configuration of the interlocking unit assembly illustrated in FIG. 2.

FIG. 5 is a front view illustrating an internal configuration of the interlocking unit assembly illustrated in FIG. 2. FIG. 5 illustrates the latch 205 in the latched position. As illustrated in FIG. 5, the latch 205 is biased to rotate from the latched position to the open position (in an anticlockwise direction in FIG. 5) by the engagement portion 205*b* engaging with a spring 209.

Returning to FIG. 3, the pawl 206 is assembled with the pawl assembling hole 201*b* formed in the body 201. Further, the pawl 206 is pivotally supported to be turnable, with a shaft portion 206*a* at a front portion thereof being inserted through a shaft hole 203*c* of the back plate 203 and a shaft portion 206*b* at a rear portion thereof being inserted through a shaft hole 202*c* of the cover plate 202.

Next, FIG. 5 illustrates the pawl 206 in an engaged position. The pawl 206 is biased by a spring 210, to rotate from a released position where engagement with the latch 205 is canceled, in a direction towards the engaged position where the pawl 206 is engageable with the latch 205 in the latched position. That is, the pawl 206 is biased in a clockwise direction in FIG. 5.

Further, the pawl 206 has a release lever 206*c* that cancels the engagement with the latch 205 by the pawl 206 being abutted against and rotated by a later described release member 302 of the operating unit assembly 300, from the engaged position to the released position, based on an opening operation on a handle provided in the door.

Figure 6:
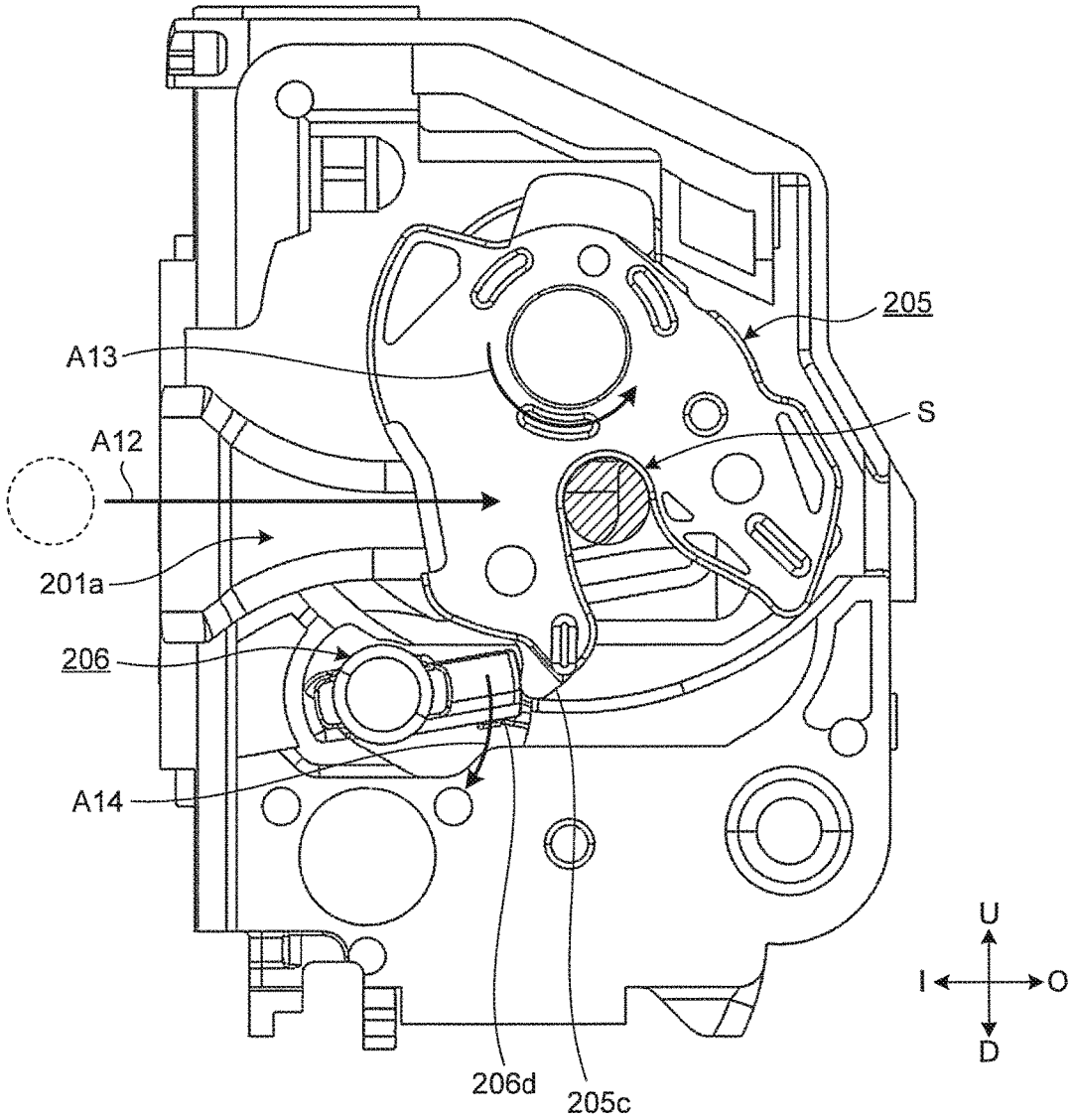
FIG. 6 is a rear view illustrating the internal configuration of the interlocking unit assembly illustrated in FIG. 2.

FIG. 6 is a rear view illustrating the internal configuration of the interlocking unit assembly illustrated in FIG. 2. FIG. 6 illustrates the pawl 206 in the engaged position and the pawl 206 is biased in an anticlockwise direction. As a result, the pawl 206 rotates from the engaged position to the released position in conjunction with rotation of the latch 205, rotates from the released position to the engaged position by biasing force, and engages with the latch 205, to thereby restrain the door in the closed position. Further, the pawl 206 has an engagement portion 206*d* that is engageable with the latch 205 that has interlocked with the striker S.

Returning to FIG. 3, the outside lever 207 has a two-division structure formed of a first lever 207*a* having a shaft hole 207*aa* through which the pivot 201*d* of the body 201 is inserted, and a second lever 207*b* overlapping a front side of this first lever 207*a* and having a shaft hole 207*ba* through which the pivot 201*d* of the body 201 is inserted. Each of the first lever 207*a* and the second lever 207*b* is rotatably supported by the pivot 201*d*, by the pivot 201*d* integrally formed forward with the body 201 to be parallel with the latch shaft 204 being inserted in the cross shaped hole 203*a* of the back plate 203.

The first lever 207*a* is, as illustrated in FIG. 5, biased to rotate from a cancel position to a standby position (in a clockwise direction in FIG. 5) by a spring 211.

Figure 7:
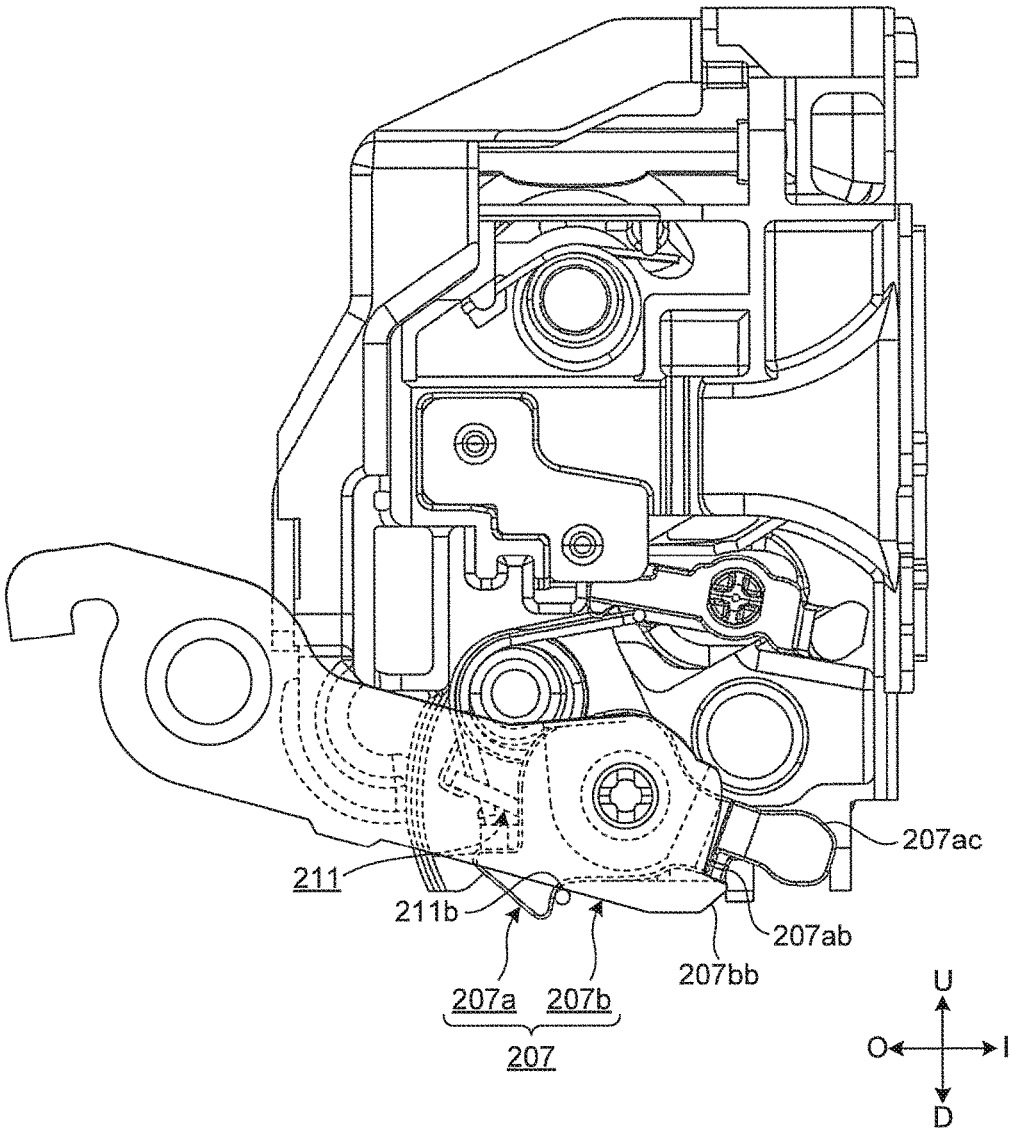
FIG. 7 is a front view illustrating a positional relation between a first lever and a second lever of the interlocking unit assembly illustrated in FIG. 2.

FIG. 7 is a front view illustrating a positional relation between the first lever and the second lever of the interlocking unit assembly illustrated in FIG. 2. As illustrated in FIG. 7, the second lever 207*b* is biased to rotate from the cancel position to the standby position (in a clockwise direction in FIG. 7) by the spring 211.

The first lever 207*a* and the second lever 207*b* integrally move in conjunction with each other from the standby position illustrated in FIG. 7 to the released position (in the clockwise direction in FIG. 7) by abutment of an engagement portion 207*bb* against a lower surface of an engagement portion 207*ab*, the engagement portion 207*bb* being the second lever 207*b*, protruding to the indoor side, and being claw shaped, and the engagement portion 207*ab* being of the first lever 207*a* and extending in a ear direction of the first lever 207*a*.

An end portion of the second lever 207*b* on the outdoor side is coupled to an outside handle (illustration thereof omitted) provided in an outer panel of the door via an operation force transmission member (illustration thereof omitted), such as a rod. When an opening operation is performed on the outside handle, via the later described release member 302 of the operating unit assembly 300 coupled to an end portion 207*ac* of the first lever 207*a* on the indoor side, input based on the opening operation is placed on the release lever 206*c* of the pawl 206 and the door is able to be opened.

That is, by rotating from the cancel position to the standby position based on the opening operation on the outside handle, which is provided on the door and is for opening the door from outside of the vehicle body, the outside lever 207 is able to rotate the pawl 206 moving in conjunction therewith from the released position to the engaged position and to cancel the engagement between the latch 205 and the pawl 206.

Figure 8:
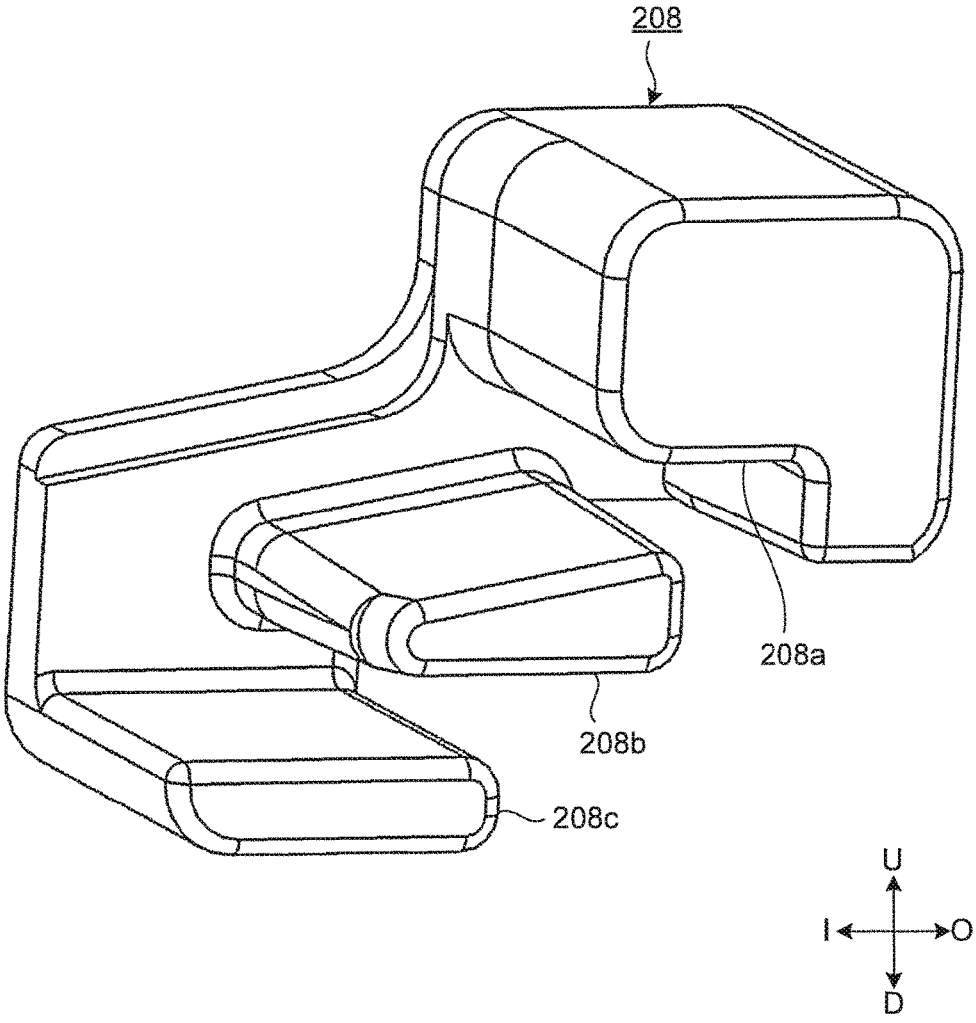
FIG. 8 is a perspective view of a rear side of a bumper rubber of the interlocking unit assembly illustrated in FIG. 2.

The bumper rubber 208 is made of an elastic member, such as rubber. FIG. 8 is a perspective view of a rear side of the bumper rubber of the interlocking unit assembly illustrated in FIG. 2. As illustrated in FIG. 8, the bumper rubber 208 has a striker abutting portion 208*a* that abuts against the striker that has advanced thereto, a protruding portion 208*b* that is fitted to the body 201, and a pawl abutting portion 208*c* that abuts against the pawl 206.

The bumper rubber 208 is assembled with the bumper rubber assembling hole 201*c* of the body 201, from a front side, which is at a shallower side of the plane of the paper of FIG. 4. When that is done, the striker abutting portion 208*a* is fitted into a space above the tongue portion 201*ca* such that a part of the striker abutting portion 208*a* is exposed to a striker advancing groove 201*a* side of the body 201. Further, the protruding portion 208*b* is fitted in between the tongue portion 201*ca* and the lower end portion 201*cb*. The pawl abutting portion 208*c* is positioned below the lower end portion 201*cb* and accommodated in a space formed at a front side of the body 201.

Figure 9:
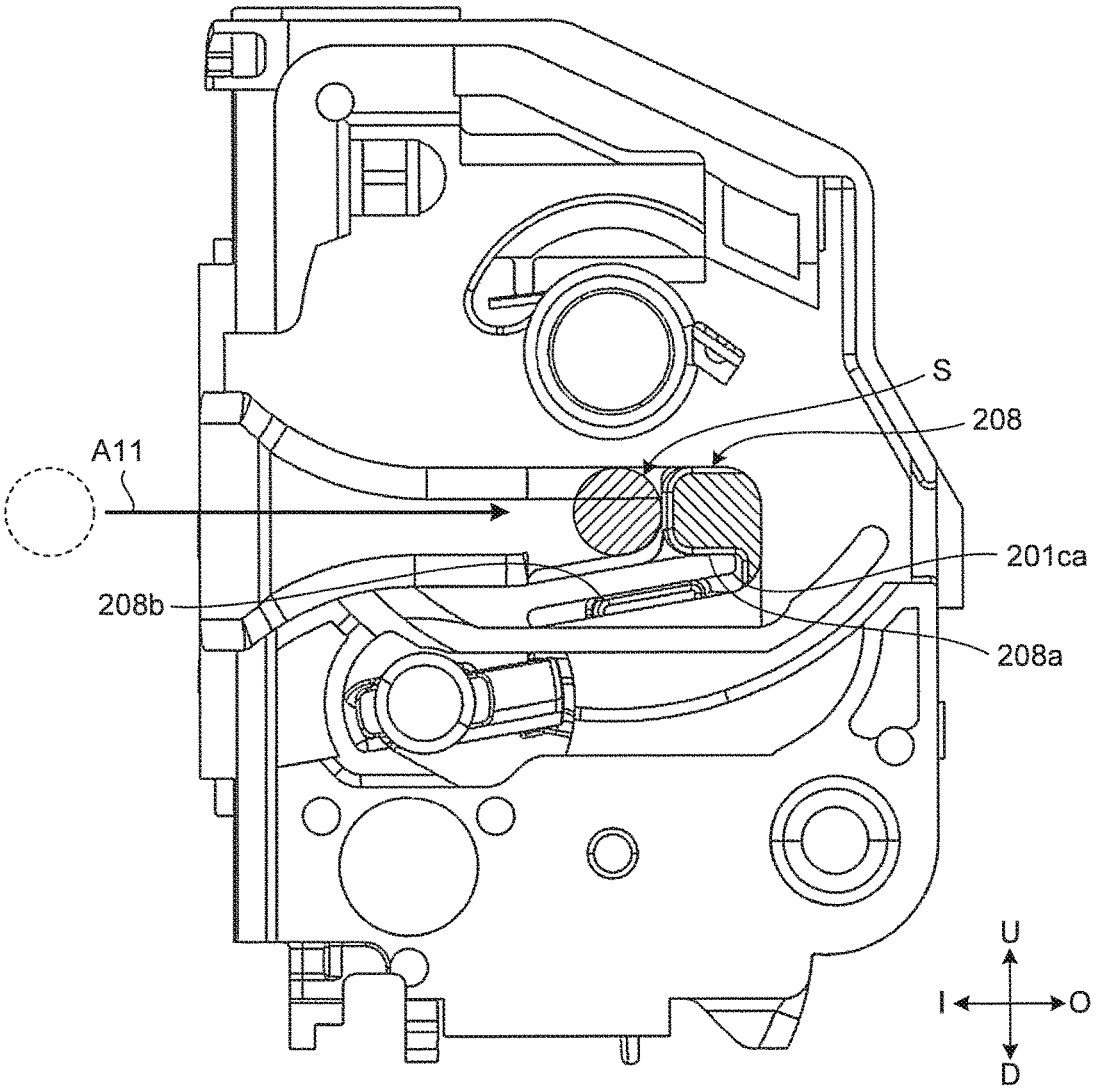
FIG. 9 is a rear view illustrating a position of the bumper rubber of the interlocking unit assembly illustrated in FIG. 2.

FIG. 9 is a rear view illustrating a position of the bumper rubber of the interlocking unit assembly illustrated in FIG. 2. As illustrated in FIG. 9, the striker abutting portion 208*a* of the bumper rubber 208 is arranged at an innermost portion of the striker advancing groove 201*a* of the body 201. The striker S that has advanced as illustrated with an arrow A11 in FIG. 9 is guided by the tongue portion 201*ca* and abuts against the striker abutting portion 208*a*. When that happens, deformation in an up-and-down direction of the bumper rubber 208 due to impact of the striker S is prevented by the tongue portion 201*ca* and the protruding portion 208*b*. Further, an end portion of the striker abutting portion 208*a* on the outdoor side thereof extends downwards (see FIG. 8) and by this extending portion abutting against a distal end of the tongue portion 201*ca*, displacement of the bumper rubber 208 in an inside-outside direction of the automobile is prevented.

Furthermore, as illustrated in FIG. 5, the pawl 206 rotating from the released position to the engaged position abuts against the pawl abutting portion 208*c* formed at a lower end portion of the bumper rubber 208 and the bumper rubber 208 absorbs impact due to biasing force of the pawl 206.

Returning to FIG. 5, the spring 209 biases the latch 205, with one end portion 209*a* thereof being hooked on a projecting portion 201*f* of the body 201 at a front side, which is a shallower side of the plane of the paper, and another end portion 209*b* thereof being hooked on the engagement portion 205*b* of the latch 205.

The spring 210 biases the pawl 206, with one end portion 210*a* thereof being hooked on a projecting portion 201*g* of the body 201 and another end portion 210*b* thereof being hooked on an engagement portion 206*e* of the pawl 206.

The spring 211 biases the first lever 207*a* and the second lever 207*b*, with one end portion 211*a* thereof being hooked on the projecting portion 201*g* of the body 201 and another end portion 211*b* thereof being hooked on an engagement portion 207*ad* of the first lever 207*a*.

Returning to FIG. 3, the bolt V1 penetrates through an attachment hole (illustration thereof omitted) of an inner panel of the door, a through hole 202*d* of the cover plate 202, and a through hole 201*h* of the body 201 in this order, and is screwed into a screw hole 203*d* of the back plate 203.

A bolt V2 and a bolt V3 penetrate through attachment holes (illustration thereof omitted) of the inner panel of the door and are screwed into a screw hole 202*e* and a screw hole 202*f* of the cover plate 202, respectively. The interlocking unit assembly 200 is fixed, together with the operating unit assembly 300, to the inner panel of the door, by these bolt V1 to bolt V3. When that is done, by the bolt V1 being screwed into the screw hole 203*d* of the back plate 203 also, the back plate 203 is fixed to a reverse side of the body 201.

Next, operation of the interlocking unit assembly 200 will be described.

First, operation of the interlocking unit assembly 200 when the door is brought from an open state to the closed state will be described. When a door closing operation is performed and as illustrated with an arrow A12 in FIG. 6, the striker S advances into the striker advancing groove 201*a* of the body 201, the latch 205 rotates, as illustrated with an arrow A13, from the open position to the latched position illustrated in FIG. 6 via the half closed door position. When that happens, at the innermost portion of the striker advancing groove 201*a* of the body 201, the striker S and the bumper rubber 208 abut against each other.

Further, by abutting against the latch 205, the engagement portion 206*d* of the pawl 206 is pushed down and the pawl 206 is rotated in a direction of an arrow A14. Thereafter, the pawl 206 rotates in a direction biased by the spring 210 (in an anticlockwise direction in FIG. 6) and an engagement portion 205*c* of the latch 205 engages with the engagement portion 206*d* of the pawl 206. This state, where the striker S and the latch 205 are interlocked with each other, and the engagement portion 205*c* of the latch 205 and the engagement portion 206*d* of the pawl 206 are engaged with each other, is the closed state of the door.

Next, operation of the interlocking unit assembly 200 when the door is brought from the closed state to the open state will be described. When, in the closed state of the door, input based on an opening operation on the handle is placed on the release lever 206*c* of the pawl 206, the pawl 206 rotates from the engaged position to the released position as illustrated with an arrow A14 in FIG. 6, and the engagement between the engagement portion 205*c* of the latch 205 and the engagement portion 206*d* of the pawl 206 is canceled. The latch 205 is then rotated from the latched position to the open position by the biasing force, and the interlock between the striker S and the latch 205 is canceled. When the door is further operated to be opened in an outdoor direction from this state, the door is brought into the open state. When the input based on the opening operation on the handle is canceled, the pawl 206 rotates and returns from the released position to the engaged position by the biasing force of the spring 210, and abuts against the bumper rubber 208 as illustrated in FIG. 5.

Next, a configuration of the operating unit assembly 300 will be described. The operating unit assembly 300 has a function of, in an unlocked state, by an opening operation on the outside handle on the outdoor side of the door or on an inside handle on the indoor side of the door, canceling the engagement between the latch 205 of the interlocking unit assembly 200 and the striker to cause the door to be openable, and in a locked state, even if an opening operation is performed on the outside handle or inside handle, causing the door to be not openable.

Figure 10:
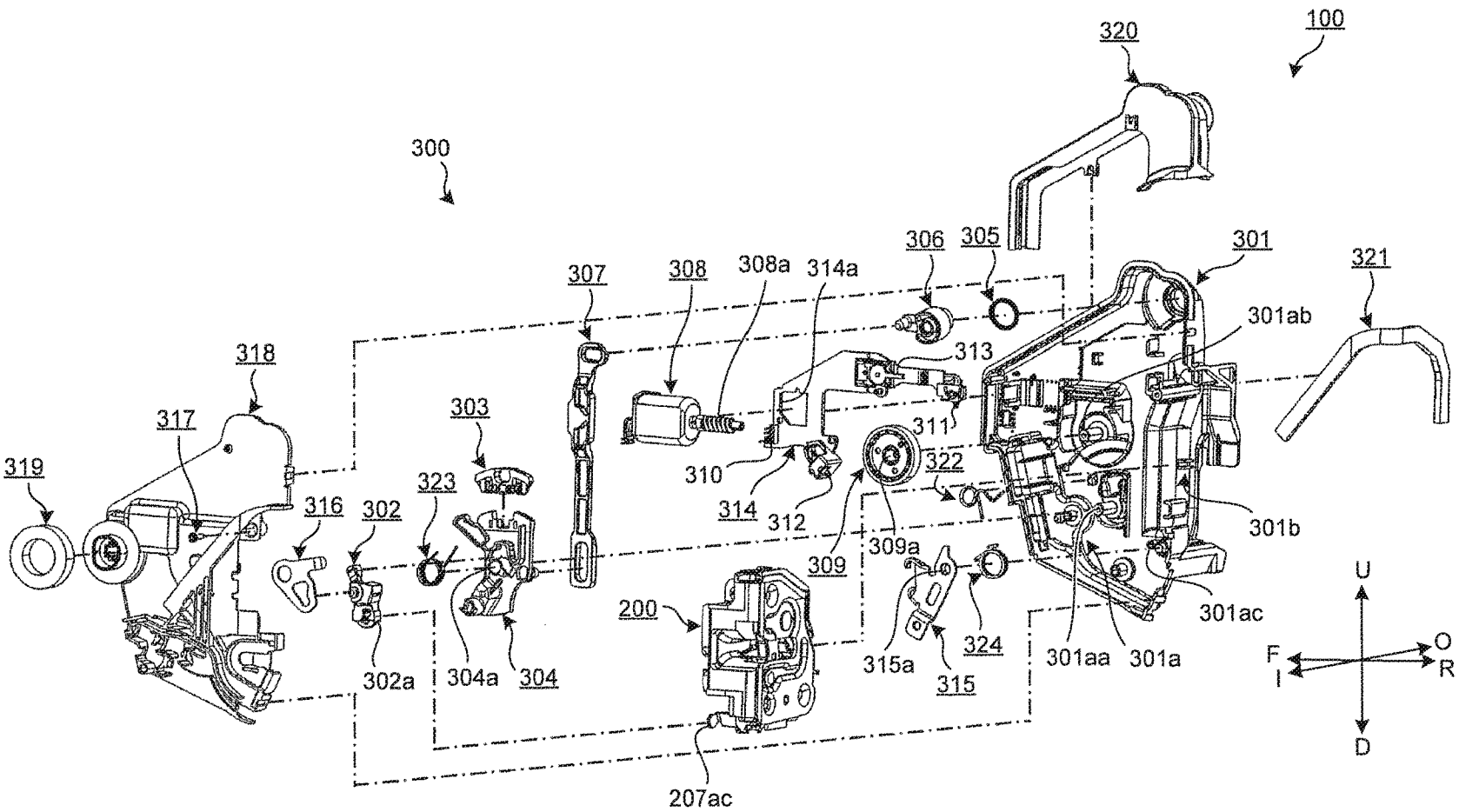
FIG. 10 is an exploded perspective view illustrating a configuration of an operating unit assembly of the vehicle door latch device illustrated in FIG. 1.

FIG. 10 is an exploded perspective view illustrating a configuration of the operating unit assembly of the vehicle door latch device illustrated in FIG. 1. As illustrated in FIG. 10, the operating unit assembly 300 is assembled, together with the interlocking unit assembly 200, in a casing 301 that is made of synthetic resin and substantially L-shaped in a plan view.

The operating unit assembly 300 includes: the release member 302, which engages with the above described first lever 207*a* of the outside lever 207; a lock lever 304, which engages with the release member 302, is fitted with a cam silencer 303, and is able to be switched over between a locked position and an unlocked position; a slide lever 307, which moves in conjunction with a key access 306 inserted through a ring 305, and is able to switch over the lock lever 304 between the locked position and the unlocked position; a motor 308 for locking and unlocking operation; a worm wheel 309, which is interlocked with a worm 308*a* fixed to a rotation axis of the motor 308 and with the cam silencer 303 and is able to switch over the lock lever 304 between the locked position and the unlocked position; a coupler 310; a half-closed door detection switch 311, which detects position of the latch 205; a lock/unlock detection switch 312, which detects position of the lock lever 304; a switch plate 314, which is integrally assembled to the casing 301 such that a key switch 313, which performs detection of position of the slide lever 307, is coupled thereto; an inside lever 315, which makes the door openable by an opening operation on the inside handle; and a cancel lever 316 that engages with the release member 302.

The interlocking unit assembly 200 and the operating unit assembly 300 are accommodated in a case formed of: the casing 301; a cover member 318, which covers an opening of the casing 301 on the indoor side, is fixed to the casing 301 with a screw 317, and is made of synthetic resin; a coupler cushion 319, which is fitted to the cover member 318 from the outdoor side and protects an outer periphery of the coupler 310; a waterproof cover 320, which is fitted from above, is for preventing rainwater or the like from entering the case, and is made of synthetic resin; and a water proof seal, which is attached to a side surface of the cover member 318 on the indoor side, and prevents rainwater or the like from entering inside the automobile.

Next, each member of the operating unit assembly 300 will be described in detail.

The casing 301 is made of, for example, synthetic resin, is fitted with the interlocking unit assembly 200, and assembled with an operating mechanism of the operating unit assembly 300. The casing 301 includes: an operating unit assembly accommodating portion 301*a* with an indoor side thereof being open; and an interlocking unit assembly accommodating portion 301*b*, which extends out substantially perpendicularly from a rear end of this operating unit assembly accommodating portion 301*a* in the outdoor direction and is continuous with the operating unit assembly accommodating portion 301*a*.

The release member 302 moves in conjunction with the outside lever 207, with the end portion 207*ac* of the first lever 207*a* of the outside lever 207 on the indoor side being coupled to a coupling portion 302*a* thereof. Further, the release member 302 abuts against and moves in conjunction with the inside lever 315 that rotates by an opening operation on the inside handle in the unlocked state.

A groove formed at an upper center of the cam silencer 303 engages with an engagement portion (illustration thereof omitted) formed on the outdoor side of the worm wheel 309.

The lock lever 304 is assembled in the operating unit assembly accommodating portion 301*a* by a shaft tube 304*a* being fitted, from the indoor side, to a support shaft 301*aa*, the shaft tube 304*a* being oriented in the inside-outside direction of the automobile, and the support shaft 301*aa* projecting from a side surface of the operating unit assembly accommodating portion 301*a* and faced to the indoor side. The lock lever 304 is respectively biased by a turn-over spring 322 towards the locked position when the lock lever 304 is in the locked position and towards the unlocked position when the lock lever 304 is in the unlocked position.

Moreover, the shaft tube 304*a* of the lock lever 304 is inserted in a spring 323 and the release member 302 is assembled from above thereof. As a result, the release member 302 is biased by the spring 323 in a direction (downwards in FIG. 10) in which the engagement with the pawl 206 is canceled.

Further, the lock lever 304 is switched over, by operation of the slide lever 307 and the motor 308, between the locked position where the release member 302 does not engage with the pawl 206 and the unlocked position where the release member 302 engages with the pawl 206.

The key access 306 is rotated by locking and unlocking operations of a key cylinder (illustration thereof omitted) provided in the outer panel of the door.

The slide lever 307 is installed in the operating unit assembly accommodating portion 301*a* from the indoor side. The slide lever 307 moves in an up-and-down direction in conjunction with rotation of the key access 306 and switches over the lock lever 304 between the locked position and the unlocked position.

The motor 308 is placed on the switch plate 314 so that a bottom portion thereof fits in an opening 314*a* formed at an approximate center of the switch plate 314. The motor 308 switches over the lock lever 304 between the locked position and the unlocked position by the worm 308*a* fixed to the rotation axis interlocking with the worm wheel 309 and normally and reversely rotating.

The worm wheel 309 is installed in the operating unit assembly accommodating portion 301*a* from the indoor side by a shaft hole 309*a* at a center thereof being fitted to a support shaft 301*ab*, which projects from a central portion of the operating unit assembly accommodating portion 301*a* and faces the indoor side. Teeth formed on an outer periphery of the worm wheel 309 engage with the worm 308*a* of the motor 308 and the engagement portion thereof formed on the outdoor side engages with the cam silencer 303. As a result, the worm wheel 309 switches over the lock lever 304 between the locked position and the unlocked position by the rotation of the motor 308.

The inside lever 315 is installed in the operating unit assembly accommodating portion 301*a* from the indoor side by a shaft hole 315*a* in an upper end portion thereof being fitted to a support shaft 301*ac*, which protrudes from a side surface at a rear end portion of the operating unit assembly accommodating portion 301*a*, faces the indoor side, and is inserted through a spring 324. The inside lever 315 is biased, by the spring 324, to rotate in a direction (anticlockwise direction in FIG. 10) of returning an opening operation by the inside handle to the standby state. In the unlocked state, the inside lever 315 causes the door to be openable by an opening operation on the inside handle.

The cancel lever 316 engages with the release member 302. By the cancel lever 316, when a locking operation is performed on a lock knob to be brought into the locked state in a state where the door is open, and the door is closed in that state, as the door becomes closed, the locked state is canceled and switched over to the unlocked state, and when a locking operation is performed on the lock knob to be brought into the locked state in a state where the door is open and the door is closed while an opening operation is performed on the outside handle, the locked state is not canceled.

Next, operation of the operating unit assembly 300 will be described.

Figure 11:
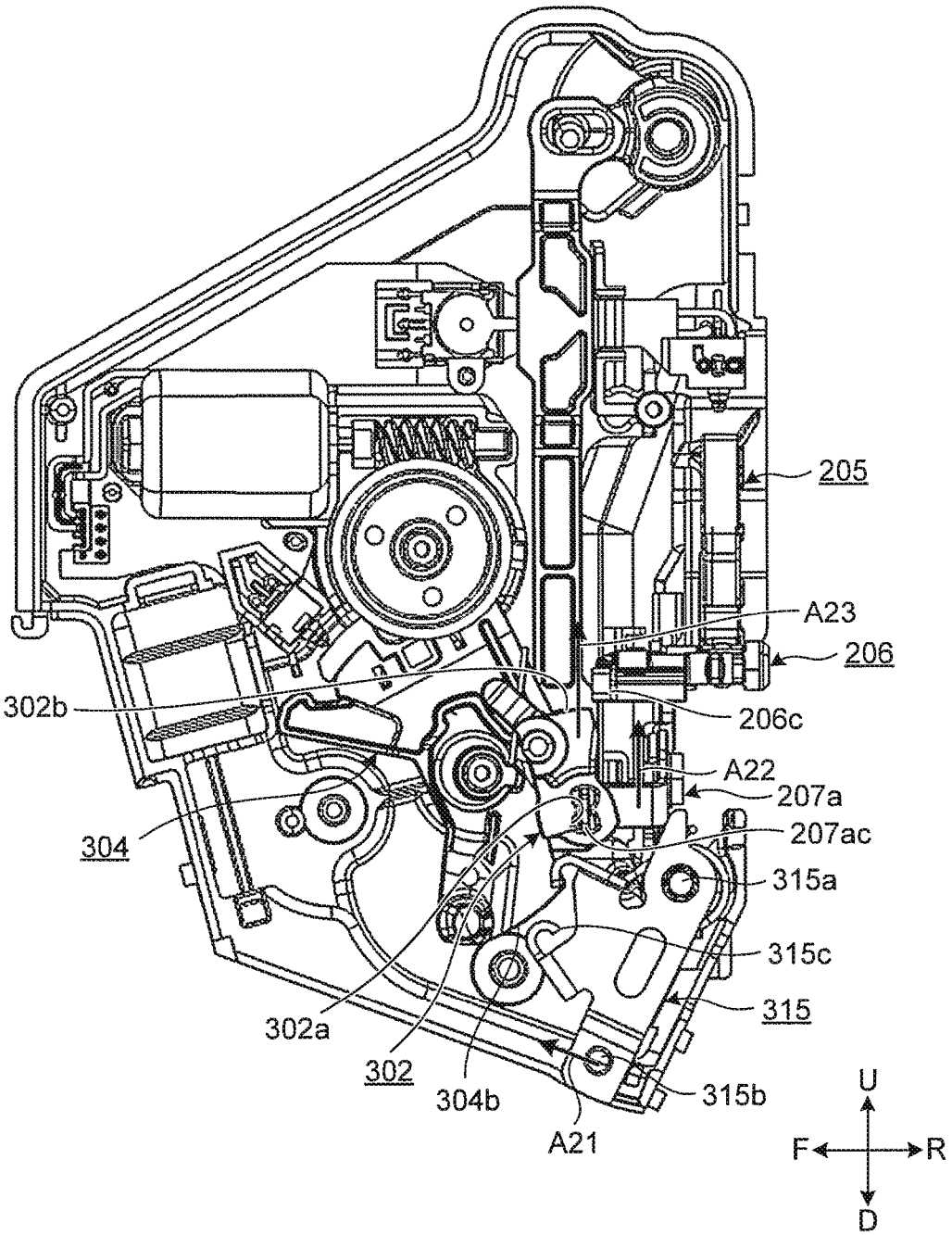
FIG. 11 is a diagram for explaining operation of the operating unit assembly illustrated in FIG. 10 in a locked state.

First, a case where the door is in the locked state, that is, a case where the lock lever 304 is in the locked position, will be described. FIG. 11 is a diagram for explaining operation of the operating unit assembly illustrated in FIG. 10 in the locked state. FIG. 11 is a diagram of the door latch device 100 as viewed from the indoor side, which is a shallower side of the plane of the paper.

First, as illustrated in FIG. 11, when a door opening operation is performed on the inside handle, an engagement portion 315*b* of the inside lever 315 is pulled in a direction of an arrow A21. That is, the inside lever 315 is added with force in a direction of rotating about the shaft hole 315*a*. When that happens, an engagement portion 315*c* of the inside lever 315 and an engagement portion 304*b* of the lock lever 304 abut against each other, and the inside lever 315 does not rotate. Therefore, the closed state of the door is maintained.

Next, when a door opening operation is performed on the outside handle, in conjunction with the second lever 207*b* of the outside lever 207, the first lever 207*a* of the outside lever 207 rotates in a direction of an arrow A22. When this happens, since the end portion 207*ac* of the first lever 207*a* and the coupling portion 302*a* of the release member 302 are coupled to each other, the release member 302 moves in conjunction with the rotation of the first lever 207*a*. Even if the release member 302 moves upwards as illustrated with an arrow A23 in the locked state, an engagement portion 302*b* of the release member 302 does not abut against and hit the release lever 206*c* of the pawl 206 and thus the closed state of the door is maintained.

Accordingly, even if an opening operation is performed on the inside handle or the outside handle in the locked state, the operating unit assembly 300 operates such that the closed state of the door is maintained.

Figure 12:
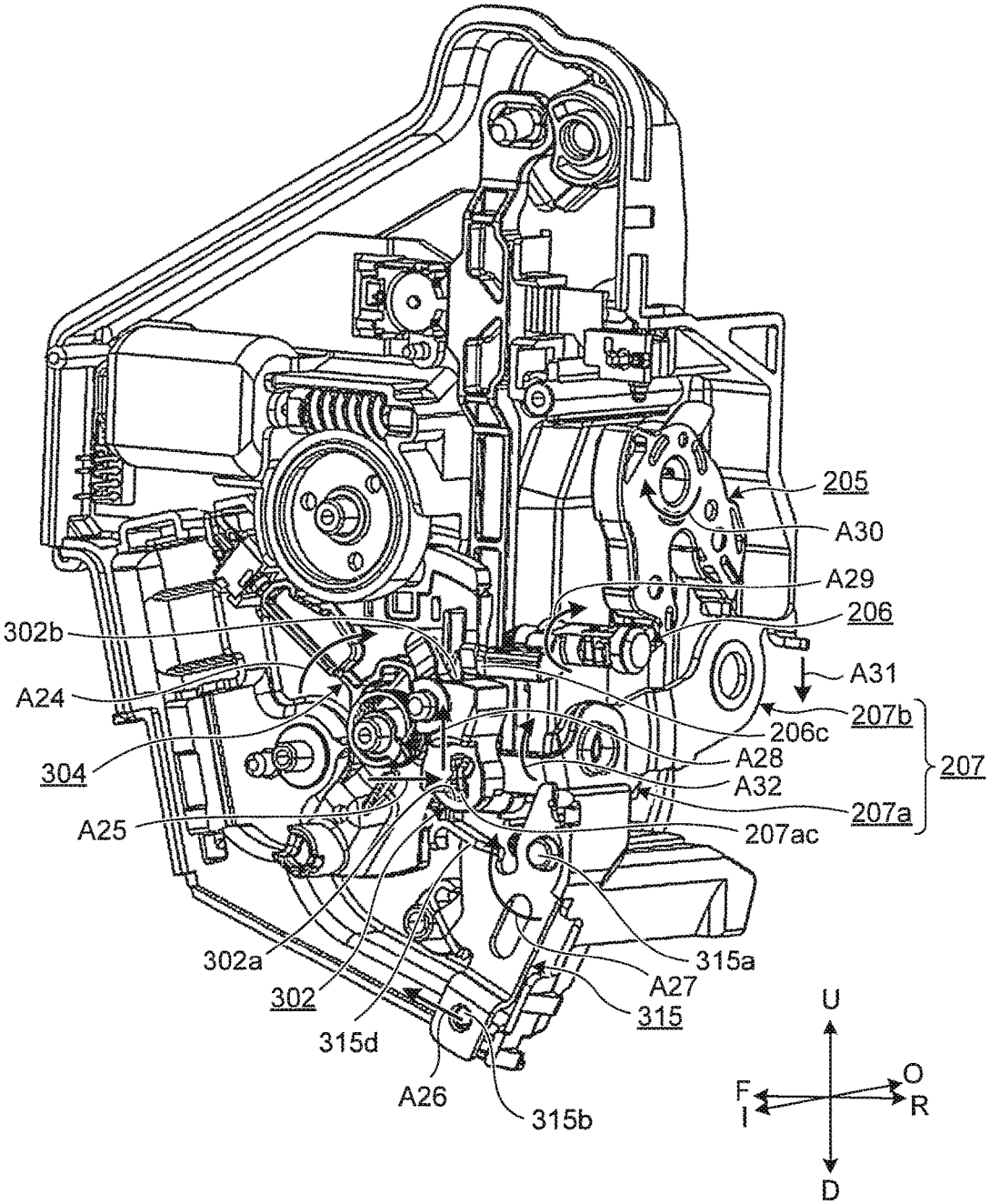
FIG. 12 is a diagram for explaining operation of the operating unit assembly illustrated in FIG. 10 in an unlocked state.

Next, a case where the door is in the unlocked state, that is, a case where the lock lever 304 is in the unlocked position will be described. FIG. 12 is a diagram for explaining operation of the operating unit assembly illustrated in FIG. 10 in the unlocked state. FIG. 12 is a perspective view of the indoor side of the door latch device 100 as viewed from the rear side.

First, in the unlocked state of the door, the lock lever 304 is positioned in the unlocked position where the lock lever 304 has rotated in a clockwise direction from the locked position as illustrated with an arrow A24. In conjunction therewith, the release member 302 is positioned on a rearer side than the locked state as illustrated with an arrow A25.

As illustrated in FIG. 12, when a door opening operation is performed on the inside handle, the engagement portion 315*b* of the inside lever 315 is pulled in a direction of an arrow A26. The inside lever 315 then rotates about the shaft hole 315*a* as illustrated with an arrow A27. When that happens, an engagement portion 315*d* of the inside lever 315 and a lower end portion of the release member 302 abut against each other, and the release member 302 moves upwards as illustrated with an arrow A28. Further, in the unlocked state, since the engagement portion 302*b* of the release member 302 and the release lever 206*c* of the pawl 206 abut against each other, the pawl 206 rotates as illustrated with an arrow A29. As a result, the engagement between the pawl 206 and the latch 205 is canceled, the latch 205 rotates as illustrated with an arrow A30, and the interlock between the latch 205 and the striker is canceled. When the door is operated to be opened in the outdoor direction from this state, the door is brought into the open state.

Next, when a door opening operation is performed on the outside handle, the second lever 207*b* of the outside lever 207 is pulled in a direction of an arrow A31. In conjunction with the second lever 207*b*, the first lever 207*a* of the outside lever 207 then rotates in a direction of an arrow A32. When this happens, since the end portion 207*ac* of the first lever

207*a* and the coupling portion 302*a* of the release member 302 are coupled to each other, the release member 302 moves upwards as illustrated with the arrow A28 in conjunction with the rotation of the first lever 207*a*. Since the engagement portion 302*b* of the release member 302 then abuts against the release lever 206*c* of the pawl 206, the pawl 206 rotates as illustrated with the arrow A29. As a result, the engagement between the pawl 206 and the latch 205 is canceled, the latch 205 rotates as illustrated with the arrow A30, and the interlock between the latch 205 and the striker is canceled. When the door is operated to be opened in the outdoor direction from this state, the door is brought into the open state.

Accordingly, in the unlocked state, when an opening operation is performed on the inside handle or the outside handle, the operating unit assembly 300 operates so that the door is brought into the open state.

Next, a process of assembling the interlocking unit assembly 200 will be described. First, the latch shaft 204 is inserted through the shaft hole 202*b* of the cover plate 202, and these are set in an automatic assembling line or the like in that state such that a front side of the cover plate 202 faces upward. The latch 205 is overlapped thereon, such that the latch shaft 204 is inserted through the shaft hole 205*a*. The body 201 is further overlapped thereon, such that the latch shaft 204 is inserted through the shaft hole 201*e*.

Next, the bumper rubber 208 is inserted in the bumper rubber assembling hole 201*c* on the front side of the body 201. When that is done, assembly is performed, such that the striker abutting portion 208*a*, the protruding portion 208*b*, and the pawl abutting portion 208*c* of the bumper rubber 208, and the tongue portion 201*ca* of the body 201 and the protruding portion 208*b* are fitted to each other. Further, the spring 209 is assembled thereto, such that the one end portion 209*a* is hooked on the projecting portion 201*f* at the front side of the body 201 and the other end portion 209*b* is hooked on the engagement portion 205*b* of the latch 205.

Subsequently, the pawl 206 is inserted in the pawl assembling hole 201*b* at the front side of the body 201. Furthermore, the spring 210 is assembled thereto, such that the one end portion 210*a* is hooked on the projecting portion 201*g* of the body 201 and the other end portion 210*b* is hooked on the engagement portion 206*e* of the pawl 206.

Thereafter, the spring 211 is arranged such that the end portion 211*a* is hooked on the projecting portion 201*g* of the body 201, and the first lever 207*a* is assembled to be overlapped thereon such that the end portion 211*b* of the spring 211 is hooked on the engagement portion 207*ad* of the first lever 207*a* and the pivot 201*d* is inserted through the shaft hole 207*aa*. Moreover, the second lever 207*b* is overlapped thereon such that the pivot 201*d* is inserted through the shaft hole 207*ba*.

The back plate 203 is then overlapped thereon, such that the small diameter shaft portion 204*a* of the latch shaft 204 is unrotatably press fitted in the shaft hole 203*b* and the screw hole 203*d* is overlapped with the through hole 202*d* of the cover plate 202 and the through hole 201*h* of the body 201. Thereafter, by screwing the bolt V1 in the back plate 203, the interlocking unit assembly 200 is assembled.

An impact absorbing member that absorbs impact of a striker needs to be arranged in an innermost portion of a striker advancing groove. Therefore, conventionally, an impact absorbing member has been assembled from a rear side of a body where a striker advancing groove is formed. As a result, a process of assembling the impact absorbing member from the rear side of the body and thereafter turning the body over has been required.

However, the body 201 of the door latch device 100 has the bumper rubber assembling hole 201*c* having the opening on the front side. When the bumper rubber 208 is inserted in the bumper rubber assembling hole 201*c*, as illustrated in FIG. 9, a part of the bumper rubber 208 is positioned at the innermost portion of the striker advancing groove 201*a* and thus the striker abutting portion 208*a* of the bumper rubber 208 abuts against the striker S. As a result, in the door latch device 100, the bumper rubber 208 is able to be assembled from the front side, which is the shallower side of the plane of the paper. That is, a step of turning the body over becomes unnecessary and each member is able to be assembled from one direction (from the front side). Therefore, the door latch device 100 is a vehicle door latch device with improved assembly efficiency.

Further, conventionally, a member, which abuts against a striker and absorbs impact by the advanced striker, and a member, which abuts against a pawl rotating from a released position to an engaged position and absorbs impact due to biasing force of the pawl, have been configured as separate members. Therefore, steps of assembling these members individually have been respectively required.

However, in the door latch device 100, the striker abutting portion 208*a* that abuts against the striker S and the pawl abutting portion 208*c* that abuts against the pawl 206 are integrally configured as the bumper rubber 208. As a result, in the door latch device 100, the member that absorbs the impact by the striker S and the member that absorbs the impact by the pawl 206 are able to be assembled at once. Therefore, the door latch device 100 is a vehicle door latch device with improved assembly efficiency.

Further, conventionally, a restraining member for engaging with a latch and restraining the latch in a closed state has been required to be engaged with the latch that interlocks with a striker S and thus has been assembled on a rear side of a body where a striker advancing groove is formed. As a result, a process of assembling the restraining member from the rear side of the body and thereafter turning the body over has been required.

However, the body 201 of the door latch device 100 has the pawl assembling hole 201*b* having the opening on the front side. As a result, in the door latch device 100, the pawl 206 is able to be assembled from the front side, which is the shallower side of the plane of the paper. That is, a step of turning the body over becomes unnecessary and each member is able to be assembled from one direction (from the front side). Therefore, the door latch device 100 is a vehicle door latch device with improved assembly efficiency.

Further, conventionally, the restraining member has been assembled to the rear side of the body as described above, and a cancel lever, which is for canceling engagement between the striker and the latch based on an opening operation on a handle provided in the door, has been assembled to the front side of the body since the cancel lever engages with a release member of an operating unit assembly. That is, conventionally, the restraining member and the cancel lever have been configured as separate bodies. Further, conventionally, the restraining member and the cancel lever have been joined together by a shaft of the restraining member being inserted through a shaft hole of the cancel lever and caulking being performed.

However, the body 201 of the door latch device 100 has the pawl assembling hole 201*b*. As a result, in the door latch device 100, the restraining member and the cancel lever are able to be assembled at once. Further, since the restraining member and the cancel lever are integrally configured, a step of joining by caulking them together is not required. Therefore, the door latch device 100 is a vehicle door latch device with improved assembly efficiency.

Rotational caulking has been conventionally used, for example, as the step of joining by caulking, but this step requires at least a little less than one second and is a step that takes time as compared with other steps. Therefore, in a process of assembling a door latch device, the process taking about several seconds as a whole, if the number of such caulking steps is large, the assembly efficiency is reduced. Thus, reducing a caulking step achieves a remarkable effect for realizing a vehicle door latch device with improved assembly efficiency.

As described above, since the door latch device 100 according to this embodiment does not require a step of turning over the body, is able to be assembled from one direction, the number of members thereof is reduced, and the caulking steps are reduced, the door latch device 100 is a vehicle door latch device with improved assembly efficiency.

In the above described embodiment, the vehicle door latch device has been described as being provided on the door side and the striker has been described as being provided on the vehicle body side, but the present invention is not limited thereto. That is, the present invention is also adaptable to a case where the vehicle door latch device is provided on the vehicle body side and the striker is provided on the door side.

Further, in the above described embodiment, the vehicle door latch device has been described as being installed in the front side door of the automobile, but the vehicle door latch device of the present invention may, of course, be installed in a rear door.

Further, in the above described embodiment, the vehicle door latch device has been described as being installed in the door on the right side of the automobile, but the vehicle door latch device of the present invention may be configured to be bilaterally symmetrical with respect to a plane along the front-rear direction of the automobile when the vehicle door latch device is installed in a door on the left side of the automobile.

Further, the present invention is not to be limited by the above described embodiment. Those configured by combining as appropriate the respective elements described above are included in the present invention. Moreover, further effects and modifications are able to be easily derived by those skilled in the art. Therefore, wider aspects of the present invention are not limited to the above described embodiment and various modifications may be made.

INDUSTRIAL APPLICABILITY

As described above, a vehicle door latch device according to the present invention is useful for improving assembly efficiency of the vehicle door latch device.

REFERENCE SIGNS LIST

100 DOOR LATCH DEVICE
200 INTERLOCKING UNIT ASSEMBLY
201 BODY
201*a* STRIKER ADVANCING GROOVE
201*b* PAWL ASSEMBLING HOLE
201*c* BUMPER RUBBER ASSEMBLING HOLE
201*ca* TONGUE PORTION
201*cb* LOWER END PORTION
201*d* PIVOT
201*e*, 202*b*, 202*c*, 203*b*, 203*c*, 205*a*, 207*aa*, 207*ba*, 309*a*, 315*a* SHAFT HOLE
201*f*, 201*g* PROJECTING PORTION
201*h*, 202*d* THROUGH HOLE
202 COVER PLATE
202*a* NOTCHED PORTION
202*e*, 202*f*, 203*d* SCREW HOLE
203 BACK PLATE
203*a* CROSS SHAPED HOLE
204 LATCH SHAFT
204*a* SMALL DIAMETER SHAFT PORTION
205 LATCH
205*b*, 205*c*, 206*d*, 206*e*, 207*ab*, 207*ad*, 207*bb*, 302*b*, 304*b*, 315*b*, 315*c*, 315*d* ENGAGEMENT PORTION
206 PAWL
206*a*, 206*b* SHAFT PORTION
206*c* RELEASE LEVER
207 OUTSIDE LEVER
207*a* FIRST LEVER
207*b* SECOND LEVER
207*ac*, 209*a*, 209*b*, 210*a*, 210*b*, 211*a*, 211*b* END PORTION
208 BUMPER RUBBER
208*a* STRIKER ABUTTING PORTION
208*b* PROTRUDING PORTION
208*c* PAWL ABUTTING PORTION
209, 210, 211, 323, 324 SPRING
300 OPERATING UNIT ASSEMBLY
301 CASING
301*a* OPERATING UNIT ASSEMBLY ACCOMMODATING PORTION
301*aa*, 301*ab*, 301*ac* SUPPORT SHAFT
301*b* INTERLOCKING UNIT ASSEMBLY ACCOMMODATING PORTION
302 RELEASE MEMBER
302*a* COUPLING PORTION
303 CAM SILENCER
304 LOCK LEVER
304*a* SHAFT TUBE
305 RING
306 KEY ACCESS
307 SLIDE LEVER
308 MOTOR
308*a* WORM
309 WORM WHEEL
310 COUPLER
311 HALF CLOSED DOOR DETECTION SWITCH
312 LOCK/UNLOCK DETECTION SWITCH
313 KEY SWITCH
314 SWITCH PLATE
314*a* OPENING
315 INSIDE LEVER
316 CANCEL LEVER
317 SCREW
318 COVER MEMBER
319 COUPLER CUSHION
320 WATERPROOF COVER
321 WATERPROOF SEAL
322 TURN-OVER SPRING
V1, V2, V3 BOLT
A11, A12, A13, A14, A21, A22, A23, A24, A25, A26, A27, A28, A29, A30, A31, A32 ARROW
S STRIKER

The invention claimed is:

1. A vehicle door latch device, comprising:

a body that is provided in one of a door and a vehicle body, and includes, on one side of the body, a striker advancing groove into which a striker provided in the other one of the door and the vehicle body advances along with closing movement of the door;

a latch configured to interlock with the advanced striker and rotatable about a latch shaft between an open position and a latched position;

a pawl configured to be biased to rotate, in a direction towards an engaged position where the pawl is engageable with the latch in the latched position from a released position where engagement with the latch is canceled, and restrain the door in a closed position by rotating from the engaged position to the released position in conjunction with rotation of the latch, rotating from the released position to the engaged position by biasing force, and engaging with the latch; and a buffer that is made of an elastic member, wherein the body includes an opening and includes a buffer assembling hole that accommodates the buffer and a pawl assembling hole that accommodates the pawl, the buffer assembling hole includes a tongue portion, the tongue portion extending in a direction in which the striker advances, provided on the one side of the body, and configured to guide the advanced striker to allow the advanced striker to abut against the buffer, the opening faces the tongue portion at an innermost portion of the striker advancing groove and is configured to penetrate through the body in a direction substantially parallel to an axis direction of the latch shaft, the tongue portion is configured to divide the buffer assembling hole, the buffer is arranged at the innermost portion of the striker advancing groove, and is configured to abut against the striker that has advanced and abut against the pawl that rotates from the released position to the engaged position, the buffer includes first and second protruding portions protruding in a direction substantially parallel to the axis direction of the latch shaft, and a connection portion disposed between the first and second protruding portions, and the buffer is accommodated in the buffer assembling hole through the opening to fit the first and second protruding portions in a space of the buffer assembling hole divided by the tongue portion and to cover, with the connection portion, a part of the tongue portion which faces the opening.

2. The vehicle door latch device according to claim 1, wherein the first and second protruding portions of the buffer are configured to abut against the striker that has advanced and abut against the pawl that rotates from the released position to the engaged position, respectively.

3. The vehicle door latch device according to claim 1, wherein the opening has an internal dimension corresponding to an outline dimension of the buffer.

4. The vehicle door latch device according to claim 1, wherein the buffer further includes a based portion, from which the first and second protruding portions protrude, and the tongue portion is disposed between the latch and the base portion of the buffer.

5. The vehicle door latch device according to claim 4, wherein the tongue portion is disposed between the first and second protruding portions of the buffer.

6. The vehicle door latch device according to claim 4, wherein the first and second protruding portions of the buffer are configured to abut against the striker that has advanced and abut against the pawl that rotates from the released position to the engaged position, respectively.

* * * * *